United States Patent [19]

Nakayama et al.

[11] Patent Number: 4,672,940

[45] Date of Patent: Jun. 16, 1987

[54] AIR-FUEL MIXTURE FLOW CONTROL STRUCTURE AND METHOD OF MAKING THE SAME

[75] Inventors: Hajime Nakayama; Osamu Aoki; Shigetoshi Nishijima; Haruo Horiuchi, all of Saitama; Takuya Sugino, Tokyo; Shuichi Takagi, Saitama, all of Japan

[73] Assignee: Honda Giken Kogyo Kabushiki Kaisha, Tokyo, Japan

[21] Appl. No.: 845,632

[22] Filed: Mar. 28, 1986

[30] Foreign Application Priority Data

Apr. 1, 1985 [JP] Japan ..... 60-66678
Apr. 2, 1985 [JP] Japan ..... 60-48194[U]
Apr. 2, 1985 [JP] Japan ..... 60-48195[U]

[51] Int. Cl.[4] ..... F02M 29/00
[52] U.S. Cl. ..... 123/590; 48/189.4
[58] Field of Search ..... 123/590; 48/180.1, 189.4

[56] References Cited

U.S. PATENT DOCUMENTS

| | | | |
|---|---|---|---|
| 1,790,854 | 2/1931 | Defrance et al. | 48/189.4 |
| 2,721,791 | 10/1955 | Linn | 48/189.4 |
| 2,857,898 | 10/1958 | Cohn | 123/590 |
| 3,459,162 | 8/1969 | Burwinkle et al. | 123/593 |
| 3,918,423 | 11/1975 | Amor | 123/590 |
| 3,966,430 | 6/1976 | Stephens | 123/590 |
| 3,998,195 | 12/1976 | Scott | 123/590 |
| 4,044,077 | 8/1977 | Gupta | 48/189.4 |
| 4,078,532 | 3/1978 | Smith | 123/590 |
| 4,108,125 | 8/1978 | Marcoux et al. | 123/552 |
| 4,384,563 | 5/1983 | Siefer et al. | 123/590 |

*Primary Examiner*—E. Rollins Cross
*Attorney, Agent, or Firm*—Lyon & Lyon

[57] ABSTRACT

A flow control honeycomb structure for use in an intake passage of an engine for producing turbulent flow in an air-fuel mixture flowing through the intake passage, which structure includes a short cylindrical peripheral wall defining therein a circular passage having a substantially circular cross section, a plurality of substantially crisscross partitions joined to and disposed in the peripheral wall and dividing the circular passage into a first group of square passageways each having a substantially square cross section and a second group of four triangular passageways each having a substantially triangular cross section and a relatively large cross-sectional area, and a plurality of ribs extending obliquely from joints of those of the passageways which define the triangular passageways radially outwardly to the peripheral wall through the triangular passageways to divide each of the triangular passageways into a plurality of subpassageways of substantially the same cross-sectional area as the square passages. The square and triangular passageways are progressively narrower downstream in the direction in which the air-fuel mixture flow through the intake passage. A method of making the flow control honeycomb structure molding without producing burrs and ridges in any portion of the final honeycomb structure is also disclosed.

17 Claims, 12 Drawing Figures

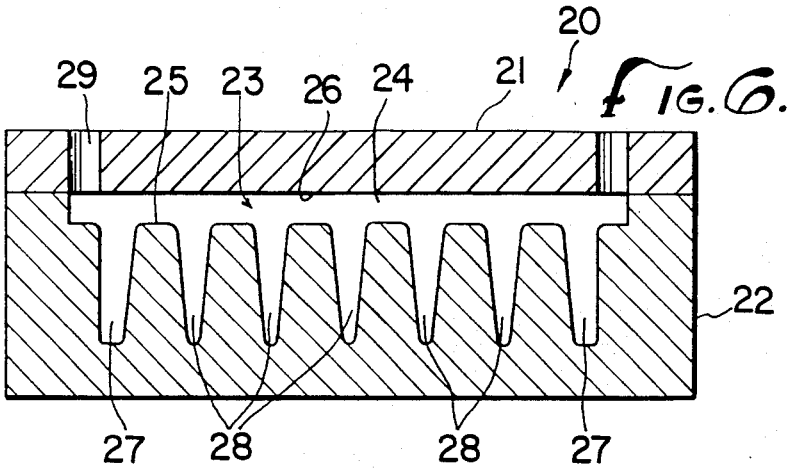
FIG. 6.
FIG. 7.
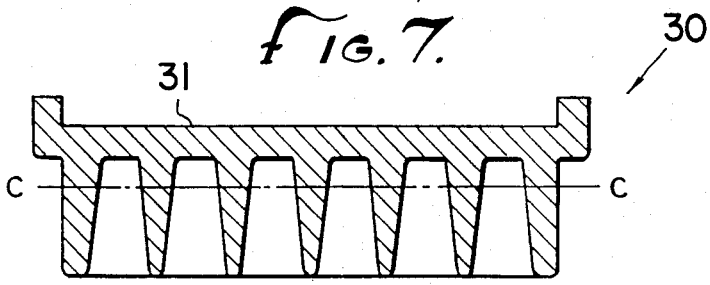
FIG. 8.
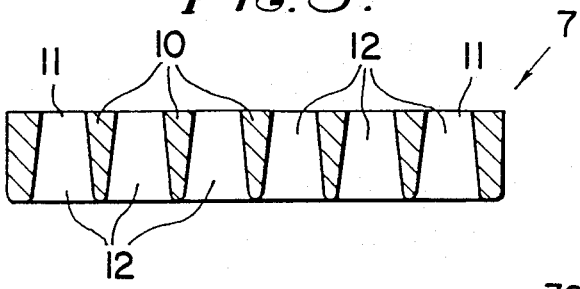
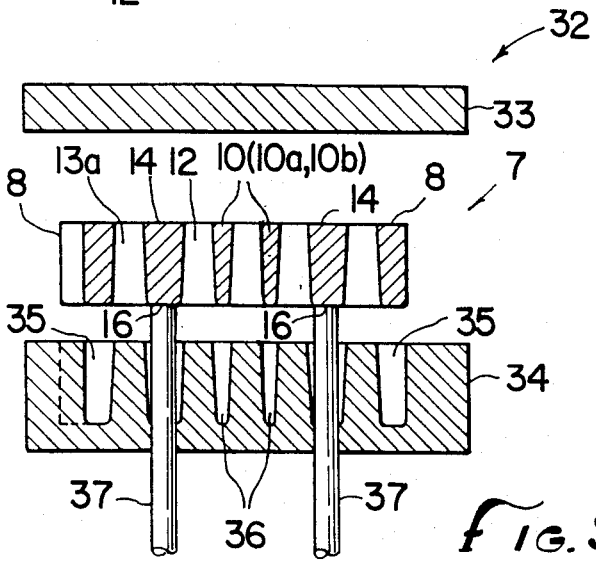
FIG. 9.

AIR-FUEL MIXTURE FLOW CONTROL STRUCTURE AND METHOD OF MAKING THE SAME

BACKGROUND OF THE INVENTION

The present invention relates to a flow control honeycomb structure for producing turbulent flows in an air-fuel mixture flowing through an air-fuel mixture intake passage coupled to an internal combustion engine in order to promote vaporization of fuel and mixture thereof with air for an improved operation efficiency of the engine, and a method of making such a flow control honeycomb structure.

Carburetors associated with internal combustion engines have venturis for drawing in and vaporizing fuel with air flowing through the venturi throat. When the engine is to be started at a low temperature, however, the fuel is not easily vaporized in the carburetor since it is also at a low temperature and a high viscosity whereby it tends to remain in large droplets. Because such large fuel droplets cannot be well mixed with air, an air-fuel mixture of desired uniform density cannot be produced.

One prior proposal to avoid such a problem has been to provide a generally conical flow control body disposed in an air-fuel mixture intake passage downstream of a carburetor, as disclosed in U.S. Pat. No. 3,998,195. The flow control body has many small passageways for an air-fuel mixture to pass therethrough to produce turbulent flow in the air-fuel mixture for promoting vaporization of fuel. The air-fuel mixture as it flows through the passageways is supposed to be disturbed and mixed across the entire cross-sectional area of the flow of the air-fuel mixture. The disclosed passageways are defined by long small holes of constant cross section, which however tend to impose large resistance on the air-fuel mixture flow therethrough. Further, the conical flow control body with such many small holes is difficult to manufacture.

It has been found that a honeycomb flow control structure positioned in an air-fuel mixture intake passage can also promote fuel vaporization for a better air-fuel mixture through disturbances or turbulences produced on the downstream side of the flow control structure.

Products of honeycomb structure are generally manufactured by combining corrugated panels. The diecasting process is also widely used to make plates of honeycomb structure that cannot easily be fabricated from such corrugated panels. Honeycomb-shaped plates for use in the air-fuel mixture passages of engines for producing turbulent flows in the air-fuel mixture are of relatively small dimensions and should preferably be cast for the purpose of mass production. Such honeycomb-shaped turbulence plates are structurally independent of the cross-sectional shapes of small passages defined therein, and hence may be of a cross-sectional shape that is selected from the standpoint of easy preparation of casing molds.

FIG. 10 of the accompanying drawings illustrates a conventional mold assembly for die-casting a honeycomb-shaped turbulence plate. The mold assembly comprises an upper mold U and a lower mold L which are combined together with mold cavities S defined therebetween for introducing a molten material therein. When a honeycomb-shaped turbulence plate is die-cast by the illustrated mold assembly, burrs or ridges are produced on the die-cast plate by the space between the upper and lower molds U, L and project into the small passageways in the turbulence plate. It would be very difficult to remove such burrs and ridges from the small passageways. The small passageways with burrs and ridges remaining therein present undesirably large resistance to the flow of an air-fuel mixture through the turbulence plate placed in the air-fuel mixture intake passage.

Conventional honeycomb-shaped turbulence plates are generally circular in cross section which are complementary to the cross-sectional shape of air-fuel intake passages in which they are to be installed. The plates have crossing partitions therein defining small passageways of substantially square cross section as shown in FIGS. 11 and 12 of the accompanying drawings which schematically illustrate two representative conventional honeycomb-shaped turbulence plates. The honeycomb-shaped turbulence plate shown in FIG. 11 comprises an overall circular-shaped passage C1 divided by crossing partitions r into passageways s of substantially square cross section and relatively small passageways a of substantially triangular cross section positioned at the periphery of the circular passage C1. The honeycomb-shaped turbulence plate shown in FIG. 12 also is circular and has a circular passage C2 divided by crossing partitions r into passageways s of substantially square cross section and relatively large passageways b of substantially triangular cross section positioned at the periphery of the circular passage C2. The triangular passageways a are much larger than the square passageways s (FIG. 11), and the triangular passageways b are much larger than the square passageways s (FIG. 12). Therefore, the air-fuel mixture flowing through the small triangular passageways a are subjected to too large resistance, and the air-fuel mixture flowing through the triangular passageways b are not subjected to adequate turbulence.

When such a honeycomb-shaped turbulence plate is die-cast in a mold, it must be removed from the mold by ejector pins. Accordingly, the die-cast plate is required to have portions for engagement by the ejector pins, which portions must have considerably larger areas as compared with the normal thickness of each partition in the honeycomb structure. Thus, those passageways which are positioned around the pin engaging portions are smaller in cross section than the other passageways. Since the pin engaging portions are normally located in the peripheral region of the turbulence plate, the peripheral region of the turbulence plate, especially as shown in FIG. 11, tends to impose large resistance to the flow of the air-fuel mixture through the turbulence plate.

When the throttle valve in the carburetor is opened to a small extent as during the starting of the engine, the air-fuel mixture tends to flow along the inner peripheral surface of the air-fuel intake passage. Thus, if the resistance to flow in the peripheral region of the turbulence plate is too large or, conversely, the passageways in the peripheral region of the turbulence plate are too large in cross-sectional area to produce adequate turbulence, the turbulence plate is not sufficiently effective in producing turbulent flows when the air and fuel are required to be well mixed. The fuel is apt to flow as a liquid film down the inner peripheral surface of the air-fuel intake passage. Consequently, the turbulence plate, particularly its peripheral region, should be effective enough to get such liquid fuel well atomized.

Another known proposal for better fuel atomization at a cold engine start is disclosed in Japanese Laid Open Utility Model Publication No. 55(1980)-83247. The disclosed arrangement includes an electric heater composed of a number of tubular bodies and disposed in an air-fuel mixture intake passage for heating an air-fuel mixture passing through the tubular bodies for promoting fuel vaporization. The tubular bodies have wall surfaces inclined toward the center of the riser of an intake manifold so that the fuel will be brought into better contact with the wall surfaces and the air-fuel mixture flowing from the tubular bodies will impinge on each other at the center of the riser. Two of the problems with the electric heater are that the electric load is increased when the engine is started, and a certain period of time is required to raise the temperature of the electric heater adequately for heating the air-fuel mixture. The air-fuel mixtures flowing from the tubular bodies are agitated by their mutual impingement, and the air and fuel mixing can be improved since the fuel is broken up into finer particles by such mutual impingement. However, since the air-fuel mixture is agitated only at the center of the riser, air and fuel cannot be well mixed completely.

Other turbulence plate and heater type devices for improving fuel vaporization are disclosed in U.S. Pat. Nos. 3,459,162; 3,826,235; 3,966,430; and 4,108,125, for example.

SUMMARY OF THE INVENTION

It is an object of the present invention to provide a flow control honeycomb structure for generating turbulent flow in an air-fuel mixture, which honeycomb structure can be cast by simple molds and has passageways of substantially equal cross-sectional area in peripheral and other regions for allowing those passageways in the peripheral region to produce sufficient turbulent flow in the air-fuel mixture for improved fuel vaporization.

Another object of the present invention is to provide a flow control honeycomb structure capable of producing turbulent flow in an air-fuel mixture throughout the cross section thereof without excessively increasing the resistance to the flow of the air-fuel mixture through the flow control honeycomb structure.

Still another object of the present invention is to provide a flow control honeycomb structure which can easily be manufactured.

A still further object of the present invention is to provide a method of making a flow control honeycomb structure through the die-casting process without allowing burrs or ridges to remain on the flow control honeycomb structure within passageways therein, so that the flow control honeycomb structure as installed in an air-fuel intake passage will not impose large resistant to the flow of an air-fuel mixture flowing through the flow control honeycomb structure.

According to the present invention, there is provided a flow control honeycomb structure for use in an intake passage of an engine for producing turbulent flow in an air-fuel mixture flowing through the intake passage, the flow control honeycomb structure including a short cylindrical peripheral wall defining therein a circular passage having a substantially circular cross section, a plurality of substantially crisscross partitions joined to and disposed in the peripheral wall and dividing the circular passage into a first group of square passageways each having a substantially square cross section and a second group of four triangular passageways each having a substantially triangular cross section and a relatively large cross-sectional area, and a plurality of ribs extending obliquely from joints of those of the partitions which define the triangular passageways radially outwardly toward the peripheral wall through the triangular passageways, thereby dividing each of the triangular passageways into a plurality of subpassageways. The square and triangular passageways are progressively narrower downstream in a direction in which the air-fuel mixture flows through the intake passage. An insulator molded of synthetic resin is adapted to be interposed between a carburetor and an intake manifold which jointly define the intake passage, the insulator having a passage communicating with the intake passage, and the peripheral wall of the flow control honeycomb structure being disposed in the passage of the insulator.

The flow control honeycomb structure is manufactured by a mold assembly comprising a first mold having a plurality of criss-crossing grooves defined in one surface thereof and having a depth larger than the thickness of the flow control honeycomb structure, and a second mold to be combined with the first mold with a gap provided between the second mold and said one surface of the first mold. A molten material is poured into the mold cavity between the first and second molds, the mold cavity including the grooves and the gap. The molded product, after it has been solidified, is removed from the first and second molds, and the burred portion is cut off from the molded product to produce the flow control honeycomb structure.

The above and other objects, features and advantages or the present invention will become more apparent from the following description when taken in conjunction with the accompanying drawings in which a preferred embodiment of the present invention is shown by way of illustrative example.

BRIEF DESCRIPTION OF THE DRAWINGS

FIG. 6 is a cross-sectional view of a mold assembly for die-casting a flow control honeycomb structure blank;

FIG. 7 is a cross-sectional view of a flow control honeycomb structure blank die-cast by the mold assembly shown in FIG. 6;

FIG. 8 is a cross-sectional view of a flow control honeycomb structure produced from the flow control honeycomb structure blank shown in FIG. 7;

FIG. 9 is a cross-sectional view showing the manner in which a flow control honeycomb structure may be die-cast by another mold assembly;

DETAILED DESCRIPTION OF THE PREFERRED EMBODIMENT

Figure 1:
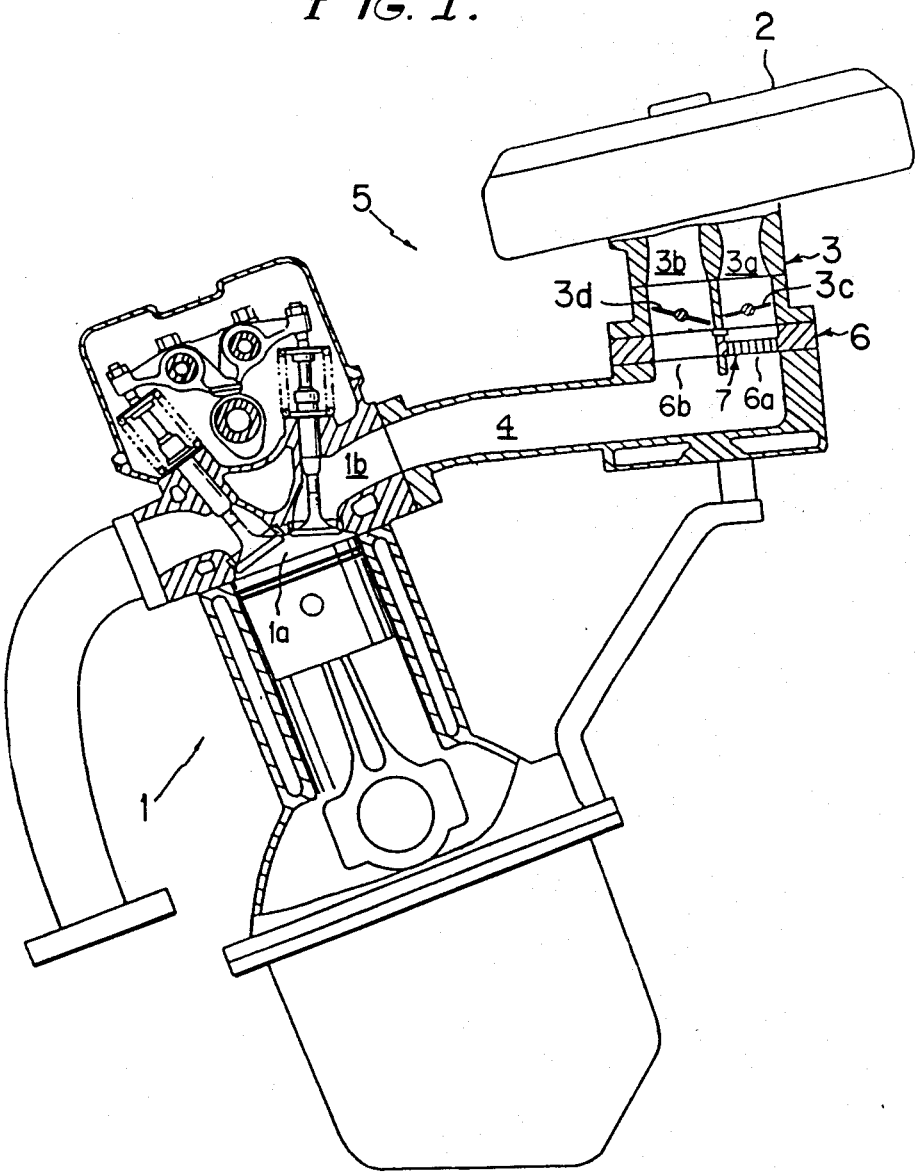
FIG. 1 is a sectional side elevational view of an internal combustion engine having a flow control honeycomb structure according to the present invention which is disposed between the carburetor and the intake passage for producing turbulent flow in an air-fuel mixture flowing therethrough.

As shown in FIG. 1, an engine assembly 1 has a combustion chamber 1*a* supplied with an air-fuel mixture from an intake system 5 comprising an air cleaner 2, a carburetor 3, and an intake manifold 4. The carburetor 3 is of the double-barrel type composed of a primary passage 3*a* which will be open when the engine operates under low and high loads and a secondary passage 3*b* which will be open only when the engine runs in a high load range. The carburetor 3 also has throttle valves 3*c*, 3*d* disposed in the primary and secondary passages 3*a*, 3*b*, respectively. The intake manifold 4 is coupled to the engine assembly 1 through the engine intake port 1*b*.

A flat insulator 6 is interposed between the carburetor 3 and the intake manifold 4 for preventing the heat generated by the engine assembly 1 during operation thereof from being transmitted through the intake manifold 4 to the carburetor 3 to avoid undue heating of the fuel in the carburetor and the passages 3*a*, 3*b* thereof. The insulator 6 is molded of a heat-resistant hard synthetic resin such as Bakelite (trademark) or phenolic resins. The insulator 6 has first and second air-fuel mixture passages 6*a*, 6*b* opening into the carburetor 3 and the intake manifold 4 and communicating respectively with the primary and secondary passages 3*a*, 3*b* of the carburetor 3. A flow control honeycomb structure 7 in the form of a circular plate-like body for producing turbulent flow in the air-fuel mixture flowing therethrough is installed in the first air-fuel mixture passage 6*a* communicating with the primary passage 3*a* in the carburetor 3. The flow control honeycomb structure 7 is made of an aluminum alloy.

Figure 2:
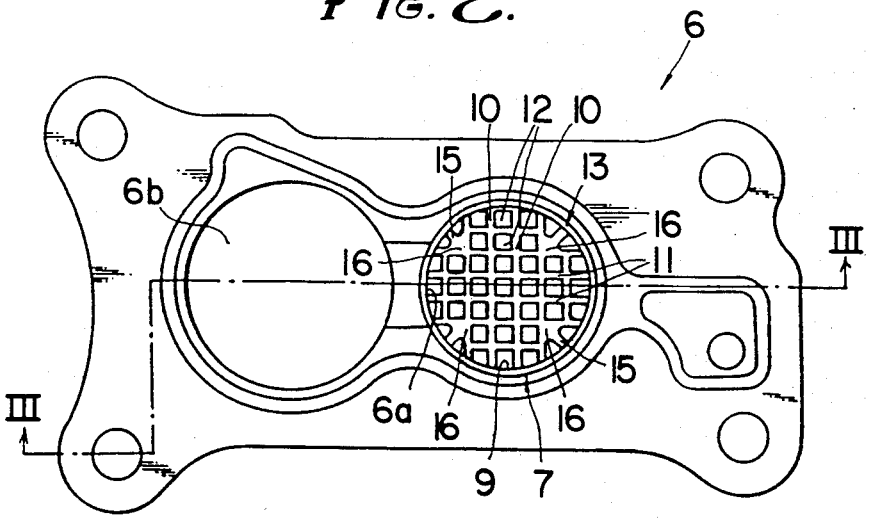
FIG. 2 is a plan view of an insulator with the flow control honeycomb structure assembled therein.
Figure 3:
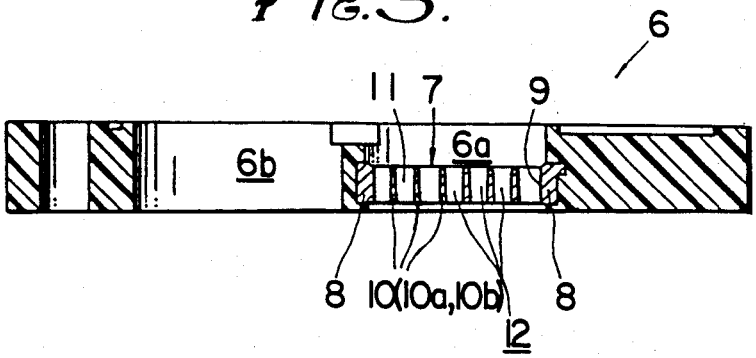
FIG. 3 is a cross-sectional elevation view taken along line III—III of FIG. 2.
Figure 4:
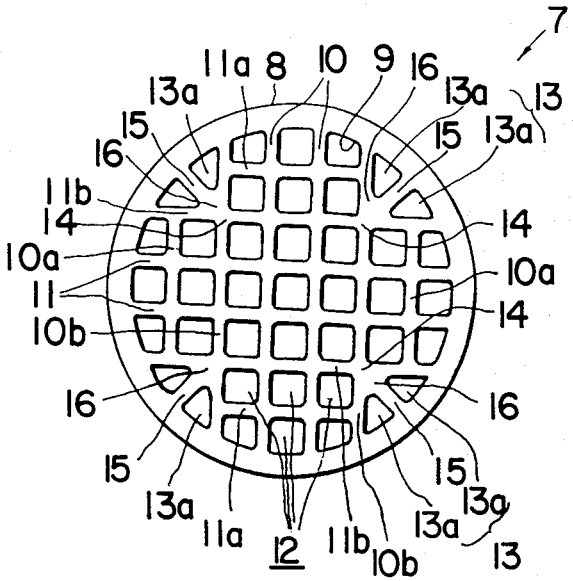
FIG. 4 is an enlarged plan view of the flow control honeycomb structure.

As shown in FIGS. 2 through 4, the flow control honeycomb structure 7 has a short cylindrical peripheral wall 8 defining an overall passage 9 of circular cross section to match the passages 3*a* and 6*a*, and a number of thin, mutually perpendicular, crossing partitions, i.e., vertical partitions 10 and horizontal partitions 11 disposed in the passage 9 and spaced at substantially equal intervals or distances. It should be noted that the terms "vertical" and "horizontal" used herein with respect to the partitions 10, 11 are merely indicative of vertical and horizontal directions, respectively, in FIGS. 2 and 4, and do not represent directions of the partitions 10, 11 in actual use. The outermost vertical and horizontal partitions 10*a*, 11*a* terminate short of peripheral wall 8, but are joined to those horizontal and vertical partitions l1*b*, 10*b*, respectively, which are located immediately adjacent and inwardly of the outermost horizontal and vertical partitions 11*a*, 10*a*. The circular passage 9 is divided by the vertical and horizontal partitions 10, 11 into a first group of many square passageways 12 of substantially square cross section and equal size, and a second group of four triangular passageways 13 having a cross-sectional shape of a substantially rectangular equilateral triangle that is defined by the peripheral wall 9 and a portion of the vertical and horizontal partitions 10*b*, 11*b* which are the second partitions from the peripheral wall 9. The four triangular passageways 13 are angularly equally spaced around the peripheral wall 8. The cross-sectional area of each of the triangular passageways 13 is over twice as large as that of each of the square passageways 12. As best shown in FIG. 4, ribs 15 extend radially outwardly and obliquely at 45° from joints 14 of the vertical and horizontal partitions 10*b*, 11*b* toward the peripheral wall 8 in order to divide the respective triangular passageways 13 into equal triangular subpassageways 13*a*, 13*a*. The joints 14 of the vertical and horizontal partitions 10*b*, 11*b* to which the ribs 15 are obliquely joined are relatively thick and bulge into the the respective triangular passageways 13. Each of the triangular subpassageways 13*a* is substantially equal in cross-sectional area to one of the square passageways 12. The upper surface (FIG. 4) of each of the joints 14 is of a large area for use as a surface 16 for engagement with an ejector pin (described later).

Figure 5:
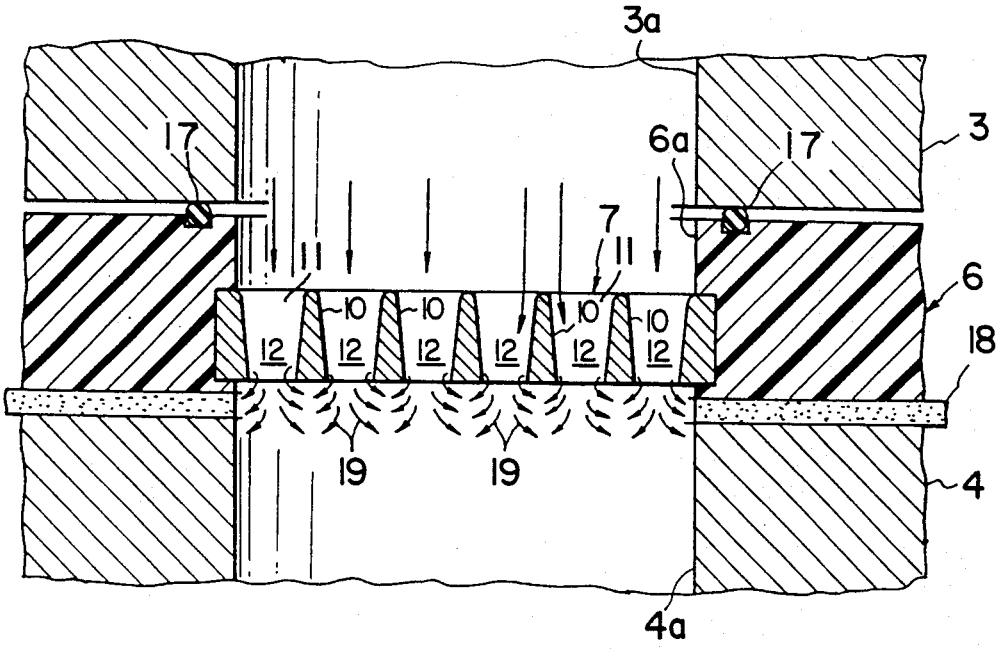
FIG. 5 is an enlarged cross-sectional elevation view of the flow control honeycomb structure as installed in the insulator and positioned in the intake passage.
Figure 10:
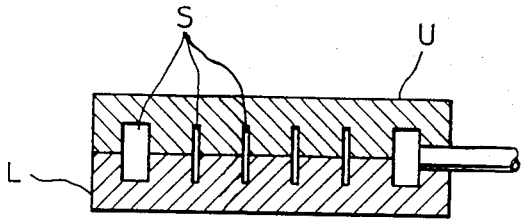
FIG. 10. PRIOR ART
FIG. 10 is a cross-sectional view of a conventional mold assembly for die-casting a flow control honeycomb structure.
Figure 11:
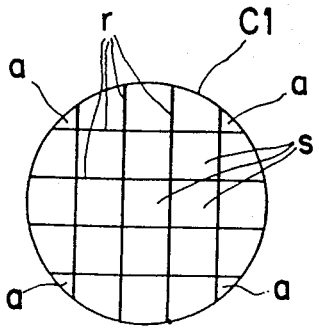
FIG. 11. PRIOR ART
FIGS. 11 and 12 are schematic plan views of conventional flow control honeycomb structures.
Figure 12:
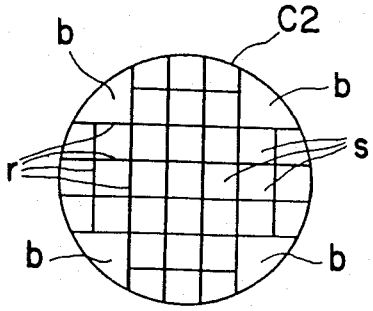
FIG. 12. PRIOR ART

As shown in FIGS. 3 and 5, the flow control honeycomb structure 7 is embedded in the insulator 6 when the latter is molded, so that the flow control honeycomb structure 7 can be anchored firmly in the insulator 6. As better illustrated in FIG. 5, the partitions 10, 11 extend substantially parallel to the axis of the first passage 6*a* of the insulator 6 and are tapered upwardly or upstream so that their thickness is progressively greater downwardly or downstream. Therefore, each of the square passageways 12 and the triangular subpassageways 13*a* extend substantially parallel to the axis of the first passage 6*a* and are progressively smaller in cross-sectional area downwardly or downstream. The insulator 6 with the flow control honeycomb structure 7 assembled therein is interposed between the carburetor 3 and the intake manifold 4 with an O-ring 17 sandwiched between the carburetor 3 and the insulator 6 and a gasket 18 sandwiched between the insulator 6 and the intake manifold 4. The insulator 6 is fastened and secured in place by bolts (not shown) by which the carburetor 3 and the intake manifold 4 are coupled to each other. As assembled, the first passage 6*a* of the insulator 6 is held in registry with the primary passage 3*a* of the carburetor 3, and the passageways 12 and the subpassageways 13*a* axially extend substantially parallel to the primary passage 3*a*, the first passage 6*a*, and a passage 4*a* defined in the intake manifold 4.

When the engine assembly 1 is started at a low temperature, an air-fuel mixture is supplied from the primary passage 3*a* of the carburetor 3. The air-fuel mixture is then passed through the flow control honeycomb structure 7 into the intake manifold 4 under vacuum developed in the combustion chamber 1*a* of the engine assembly 1. Since the air-fuel mixture flow through the passageways 12 and the subpassageways 13*a* which are progressively smaller in cross section, the air-fuel mixture is restricted thereby and its speed of flow is increased. The high-speed air-fuel mixture flow is then suddenly released at the exit ends of the passageways 12 and the subpassageways 13*a*. Therefore, strong turbulent flow, as shown by arrows 19, is produced in the air-fuel mixture immediately downstream of the flow control honeycomb structure 7, and such turbulent flow is effective in agitating the air-fuel mixture to break up the fuel into finer particles or droplets, which can be well mixed with the air.

When the engine is running at a low speed, the throttle valve 3*c* is open only a small amount. Thus, the air-fuel mixture flow mainly through the peripheral region of the flow control honeycomb structure 7. Inasmuch as the triangular subpassageways 13*a* and the square passageways 12 are substantially equal in cross section, they do not present increased resistance to the flow of the air-fuel mixture through the peripheral region of the flow control honeycomb structure 7, and hence effective turbulent flow is also produced downstream of the peripheral region of the honeycomb structure 7. The turbulent flow produced by the honeycomb structure 7 is also effective in vaporizing liquid fuel flowing down the inner peripheral surface of the first passage 6*a*. The heat of the engine assembly 1 is transmitted to the intake manifold 4, which generates radiant heat to thereby increase the temperature of the flow control honeycomb structure 7 which has a high thermal conductivity. The heated flow control honeycomb structure 7 therefore also serves to heat the air-fuel mixture flowing therethrough to promote fuel atomization.

When the engine assembly 1 is a multicylinder engine, the air-fuel mixture that is thus well and uniformly mixed is supplied through the intake manifold uniformly into the plurality of combustion chambers 1*a*.

The total cross-sectional area of the passageways 12 and the subpassageways 13*a* in the honeycomb structure 7 is sufficiently large and since the passageways 12 and the subpassageways 13*a* are of substantially uniform size, the flow control honeycomb structure 7 disposed in the first passage 6*a* does not impose substantial resistance to the flow of the air-fuel mixture through the first passage 6*a*. It should also be noted that resistance to the flow of the air-fuel mixture does not cause problems of any importance in the first passage 6*a* coupled to the primary passage 3*a*.

If the vertical and horizontal partitions 10, 11 of the honeycomb structure 7 are spaced at smaller intervals, the triangular passageways 13 may be defined by those vertical and horizontal partitions which are located inwardly of the partitions 10*b*, 11*b*. With such an alternative, each of the triangular passageways 13 is divided into more than two equal subpassageways by a plurality of ribs 15 to produce subpassageways of a cross-sectional area substantially equal to that of the square passageways.

The flow control honeycomb structure 7 may be separate from the insulator 6 and located elsewhere in the intake manifold 4. The flow control honeycomb structure 7 may be of any desired shape other than the circular configuration. The passageways 12 may be of a hexagonal shape or the like other than the illustrated square shape.

Turning now to a description of the preferred method of making the honeycomb structure 7 of this invention, FIG. 6 shows a mold assembly 20 for die-casting the flow control honeycomb structure 7. The mold assembly 20 comprises an upper mold 21 and a lower mold 22 which are combined together. It should be appreciated that the terms "upper" and "lower" are used with reference to FIG. 6 only, and should not be interpreted as being restrictive. The molds 21, 22 may be arranged vertically on their sides or used upside down as desired in actual applications. The upper mold 21 is of a flat shape, and the lower mold 22 has a mold cavity 23 opening upwardly. When the upper and lower molds 21, 22 are combined, there is a gap 24 defined between the upper surface 25 of the cavity 23 of the lower mold 22 and the lower surface 26 of the upper mold 21. The mold cavity 23 includes a circular groove 27 for forming the circular peripheral wall 8 of the honeycomb structure 7 and a number of straight grooves 28 for forming the partitions 10, 11 of the honeycomb structure 7. The mold cavity 23 also has a few radial grooves (not shown) for forming the ribs 15. The grooves 28 are tapered downwardly (as seen in FIG. 6) and extend in perpendicular crisscross relation to each other. The depth of these grooves 27, 28 is selected to be slightly larger than the thickness of the finished flow control honeycomb structure 7 to be die-cast.

In the die-casting process, a molten aluminum alloy is poured into the mold cavity 23 between the coupled upper and lower molds 21, 22 through a pouring gate 29, whereupon the molten aluminum alloy is introduced via the gap 24 into the grooves 27, 28. As a result, the grooves 27, 28 are supplied with the molten aluminum alloy through their upper open ends and filled up completely with the supplied molten aluminum alloy. As the molten aluminum alloy poured in the mold assembly 20 is cooled, it is solidified. At this time, the molten aluminum alloy in the grooves 28 narrower than the grooves 27 is solidified at a higher rate, whereupon the molten aluminum alloy in the gap 24 flow into the grooves 28. Therefore, the gap 24 serves as a riser to prevent casting defects from being produced in a die-cast product.

After the molten aluminum alloy has been solidified, the upper mold 21 is removed, and a die-cast blank 30 (FIG. 7) is pushed upwardly out of the lower mold 22 by ejector pins (not shown) inserted through the lower mold 22. Since the grooves 27, 28 are progressively wider upwardly, the die-cast blank 30 can easily be removed from the grooves 27, 28. Any possible burrs or ridges produced between the mating surfaces of the upper and lower molds 21, 22 remain only on an upper portion 31 of the blank 30.

Then, the blank 30 is cut off along a line C—C (FIG. 7) to remove the upper portion 31 with any possible burrs, thereby producing a honeycomb product as illustrated in FIG. 8, which serves as the flow control honeycomb structure 7. The flow control honeycomb structure 7 thus produced is free of any undesirable burrs. As a result, the die-cast flow control honeycomb structure 7 can easily be finished. The mold assembly 20 is relatively simple in construction since the upper mold 21 comprises a plain plate and the lower mold 22 has the circular and straight grooves 27, 28 only.

FIG. 9 shows another mold assembly 32 for die-casting the flow control honeycomb structure 7. The mold assembly 32 comprises an upper mold 33 in the form of a plate and a lower mold 34 having a circular groove 35 for forming the peripheral wall 8, a plurality of crisscross straight grooves 36 for forming the partitions 10, 11, and a few radial grooves (not shown) for forming the ribs 15. These grooves are progressively wider upwardly. Vertically slidable ejector pins 37, 37 are supported on the lower mold 34 for engaging the joints 14 of the partitions 10*b*, 11*b* of the flow control honeycomb structure 7 die-cast in the mold assembly 32. When the flow control honeycomb structure 7 is to be die-cast in the mold assembly 32, the upper and lower molds 33, 34 are held against each other with the ejector pins 37 lowered, and a molten aluminum alloy is supplied into the mold cavity between the upper and lower molds 33, 34. The molten aluminum alloy is supplied under pressure so that it can completely fill the grooves in the lower mold 34. After the molten aluminum alloy has been solidified, the upper mold 33 is removed, and the ejector pins 37 are raised to engage the pin engaging surfaces 16 for thereby pushing the formed flow control honeycomb structure 7 out of the lower mold 33.

Although a certain preferred embodiment has been shown and described, it should be understood that many changes and modifications may be made therein without departing from the scope of the appended claims.

We claim:

1. A flow control honeycomb structure for use in an intake passage of an engine for producing turbulent flow in an air-fuel mixture flowing through the intake passage, comprising:

a short cylindrical peripheral wall defining therein a circular passage having a substantially circular cross section;

a plurality of substantially perpendicular criss-cross partitions joined to and disposed in said peripheral wall and dividing said circular passage into a first group of square passageways at said cylindrical peripheral wall with each having a substantially square cross section and a second group of four triangular passageways at said cylindrical peripheral wall with each having a substantially triangular cross section and a relatively large cross-sectional area; and a plurality of ribs extending obliquely from joints of those of said partitions which define said triangular passageways radially outwardly toward said peripheral wall through said triangular passageways, thereby dividing each of the triangular passageways into a plurality of subpassageways.

2. A flow control honeycomb structure according to claim 1, wherein said triangular passageways are positioned in substantially angularly equally spaced relation adjacent to said peripheral wall.

3. A flow control honeycomb structure according to claim 1, wherein each of said joints has a relatively large surface.

4. A flow control honeycomb structure according to claim 1, wherein each of said triangular passageways has a cross-sectional shape of a rectangular equilateral triangle.

5. A flow control honeycomb structure according to claim 1, wherein said peripheral wall, said partitions, and said ribs are integrally die-cast of an aluminum alloy.

6. A flow control honeycomb structure according to claim 1, wherein said square and triangular passageways are progressively narrower downstream in the direction in which said air-fuel mixture flow through the intake passage.

7. A flow control honeycomb structure according to claim 1, further comprising an insulator molded of synthetic resin and adapted to be interposed between a carburetor and an intake manifold which jointly define said intake passage, said insulator having a passage communicating with said intake passage, said peripheral wall being disposed in said passage of the insulator.

8. A flow control honeycomb structure according to claim 1, wherein said passageways and said subpassageways are substantially equal in cross-sectional area.

9. A flow control honeycomb structure for use in an intake passage of an engine for producing turbulent flow in an air fuel mixture flowing through the intake passage, comprising:

a plate like body having a plurality of passageways extending substantially parallel to an axis of said intake passage and having a cross-sectional area progressively smaller downstream in the direction in which said air-fuel mixture flow through said intake passage said plate-like body including a short cylindrical peripheral wall defining therein a circular passage having a substantially circular cross section, a plurality of substantially crisscross partitions joined to and disposed in said peripheral wall and defining said passageways, said passageways including a first group of square passageways each having a substantially square cross section and a second group of four triangular passageways each having a substantially triangular cross section and a relatively large cross-sectional area, and a plurality of ribs extending obliquely from joints of those of said partitions which define said triangular passageways radially outwardly toward said peripheral wall through said triangular passageways, thereby dividing each of the triangular passageways into a plurality of subpassageways.

10. A method of making a flow control honeycomb structure for use in an intake passage of an engine for producing turbulent flow in an air-fuel mixture flowing through the intake passage, said flow control honeycomb structure having a plurality of passageways defined therethrough, said method comprising:

providing a first mold having a plurality of crisscrossing grooves defined in one surface thereof and having a depth larger than the thickness of the flow control honeycomb structure, and a second mold to be combined with said first mold with a gap provided between said second mold and said one surface of the first mold;

pouring a molten material into a mold cavity between said first and second models, said mold cavity including said grooves and said gap;

removing a molded product from said first and second molds; and cutting a burred portion off from said molded product including the portion formed in the gap and an integral adjacent portion formed in the criss crossing grooves to produce the flow control honeycomb structure.

11. A method according to claim 10, wherein said molten material is poured through said second mold and said gap into said grooves so that said gap serves as a riser.

12. A method according to claim 10, wherein said second mold is in the form of a plate.

13. A method according to claim 10, wherein said molten material is an aluminum alloy.

14. A method according to claim 10 wherein said grooves are tapered to narrow in a direction away from the second mold.

15. A flow control honeycomb structure for use in an intake passage of an internal combustion engine for producing turbulent flow in an air-fuel mixture flowing through the intake passage, comprising a peripheral wall defining an exterior extremity of the structure and a flow passage within said wall substantially aligning with the intake passage, a plurality of thin walls extending across said flow passage and joined to said peripheral wall, said thin walls and peripheral wall for dividing said flow passage into a plurality of passages of substantially the same cross-sectional area, and said walls being tapered to cause the cross-sectional area of each of said plurality of passages to decrease in the direction of air-fuel mixture therethrough.

16. The flow control honeycomb structure of claim 15, wherein the peripheral wall and thin walls are integrally cast as one piece.

17. The flow control honeycomb structure of claim 15, wherein said thin walls comprise a plurality of crisscrossing perpendicular partition walls forming a plurality of square passages and four substantially triangular passages with and at the peripheral wall and ribs dividing said triangular passages into passages of a cross-sectional area substantially equal to that of the square passages.

* * * * *